United States Patent [19]

Sano

[11] Patent Number: 4,545,279

[45] Date of Patent: Oct. 8, 1985

[54] ELECTRONIC MUSIC NOTE GENERATOR

[75] Inventor: Tadashi Sano, Suwa, Japan

[73] Assignee: Kabushiki Kaisha Suwa Seikosha, Tokyo, Japan

[21] Appl. No.: 407,406

[22] Filed: Aug. 12, 1982

[30] Foreign Application Priority Data

Aug. 13, 1981 [JP] Japan ..... 56-120319[U]

[51] Int. Cl.[4] ..... G10H 1/02

[52] U.S. Cl. ..... 84/1.26; 84/1.13

[58] Field of Search ..... 84/1.1, 1.26, 1.13, 84/1.01

[56] References Cited

U.S. PATENT DOCUMENTS 3,746,775 7/1973 Uchiyama ..... 84/1.26

4,160,400 7/1979 Schrecongost ..... 84/1.1

4,253,369 3/1981 Hoskinson ..... 84/1.26

4,326,443 4/1982 Bryant ..... 84/1.26

4,338,845 7/1982 Franz et al. ..... 84/1.1

*Primary Examiner*—Forester W. Isen

*Attorney, Agent, or Firm*—Blum, Kaplan, Friedman, Silberman & Beran

[57] ABSTRACT

An electronic music note generator having a volume control circuit using an RC network to control sound amplitude. Signals are formed by the discharge characteristics of an RC network and the voltage level at charging determines the volume of the sound produced. Reverberation characteristics are provided by a persistence in the signal between notes as a result of the RC discharge characteristic.

2 Claims, 9 Drawing Figures

ELECTRONIC MUSIC NOTE GENERATOR

BACKGROUND OF THE INVENTION

This invention relates generally to an electronic note generator used to output melodies and the like and more particularly to an electronic note generator having a volume control free of variable resistors. In the prior art there are several methods to control the volume of sound output. For example, the division ratio of a variable resistor is used to control volume, the gain of an amplifier is varied, or logic techniques are used to form sound waves with controlled amplitude.

When using a resistor which is tapped to provide different ratios of resistance, it is difficult to include such a volume control system within an integrated circuit because of the difficulty in providing a resistance with accurate value due to variations in the manufacturing process. When using an amplifier of variable gain for volume control, the amplifier is generally used in an analog circuit. Controlling the amplifier for volume control in a digital circuit is complicated both with regard to the accuracy and construction of the amplifier. Further, there is a problem with the linearity of the amplifier. In a logic control circuit for amplitude control, such techniques as digital to analog transformation require a complicated circuit construction in the digital circuit as shown by the method of synthesizing the sound.

What is needed is a volume control for an electronic note generator which does not require adjustment in division ratio of a resistor, rely on a variable gain amplifier or use complex logical circuit techniques.

SUMMARY OF THE INVENTION

Generally speaking, in accordance with the invention, an electronic music note generator having a volume control circuit using an RC network to control sound amplitude is provided. The signals are formed by the discharge characteristics of an RC network and the voltage level at charging determines the volume of the sound produced. Decay characteristics are provided by a persistence in the signal between notes as a result of the RC discharge characteristic.

Accordingly, it is an object of this invention to provide an improved electronic music note generator volume control which includes simple and economical circuitry.

Another object of this invention is to provide an improved electronic music note generator volume control which provides notes having a decay waveform diminishing with an RC characteristic.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
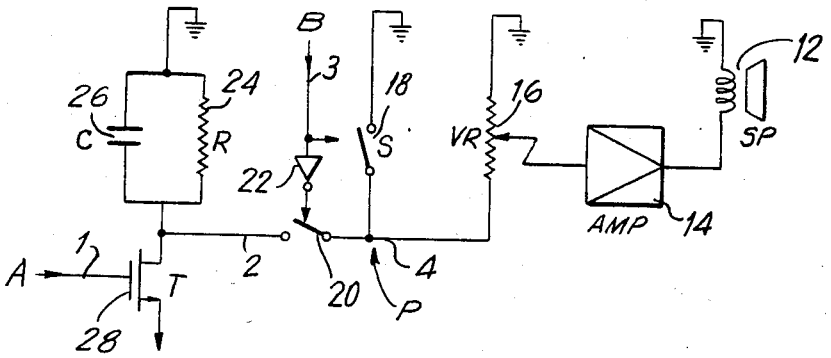
FIG. 1 is a circuit diagram of a conventional electronic music note generator.
Figure 2:
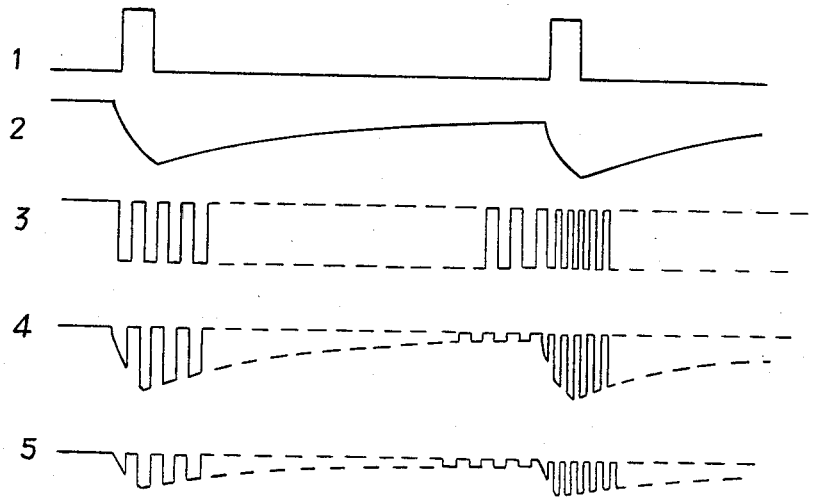
FIG. 2 illustrates timing waveforms associated with the circuit of FIG. 1.

As a result of recent advancements in electronic techniques, devices which electronically synthesize music, voice or the like and output these sounds from a speaker are becoming extremely popular. The sound volume control system of such an electronic device generally controls the amplitude rate of the amplifier. However, FIG. 1 illustrates a circuit used for an electronic music note generator providing simple notes, and FIG. 2 is a timing chart showing the waveforms at various points in the circuit of FIG. 1. The note generator of FIG. 1 comprises a speaker 12, amplifier 14, variable resistor 16, switches 18, 20, inverter 22 resistor 24, capacitor 26 and transistor 28.

A rhythm signal 1 (FIG. 2) is inputted to the gate A of the transistor 28. When the rhythm signal 1 is high, the transistor 28 becomes conductive and the capacitor 26 is charged rapidly through the transistor 28. During the time when the rhythm signal 1 has returned to the low level, the electrical charge stored in the capacitor 26 is gradually discharged through the resistor 24. Thus, a decay waveform 2 which extends between the pulses of the rhythm signal 1 is obtained with characteristics depending on the RC time constant of the capacitor 26 in combination with the resistor 24.

The notes which comprise the melody differ depending upon the frequency of the note, that is, the pitch of the sound which is to be produced. At 3 of FIG. 2 is shown a lower frequency note associated with the first pulse of the rhythm signal and a higher frequency note associated with the second pulse of the rhythm signal 1. The frequency signal 3 is inputted to the gate B of the circuit and is applied to modify the conductive state of the two switches 18, 20 alternately so that one switch is opened when the other is closed and vice versa.

As a result of combining the signals 2, 3, due to the action of the switches 18, 20, the signal 4 is produced at the point P in FIG. 1. That is, consecutive notes of different pitch or frequency are produced so as to comprise a melody in a complete sequence of notes. The frequency signals 3 have been amplitude modulated by the charge-discharge characteristic of the signal 2.

The voltage level of this modulated waveform 4 is appropriately varied to control the output volume of the speaker 12 by adjustment in the variable resistor 16. The signal tapped from the resistor 16 is supplied to the amplifier 14 in the conventional manner, and the output of the amplifier 14 drives the speaker 12. Thus, the sound volume is controlled by varying the amplitude of the waveform 4, for example, to the level of waveform 5, in accordance with the division ratio of the variable resistance 16 by the tapping point voltage of the resistor which is input to the amplifier 14.

This is a conventional variable resistance circuit for volume control and has a disadvantage in that relatively expensive parts such the variable resistor 16 are necessary. Also, the circuit lacks the ability for full electronic control of sound volume, where, for example, it is desired to have automatic sound volume control relative to the surrounding ambient noise or, for another example, an alarm clock in which the alarm sound is made to gradually increase.

In order to eliminate the above disadvantages, the volume control circuit for an electronic music note generator in accordance with the invention utilizes a control circuit which varies the stored electric charge in the capacitor 26 of the RC network.

Figure 3:
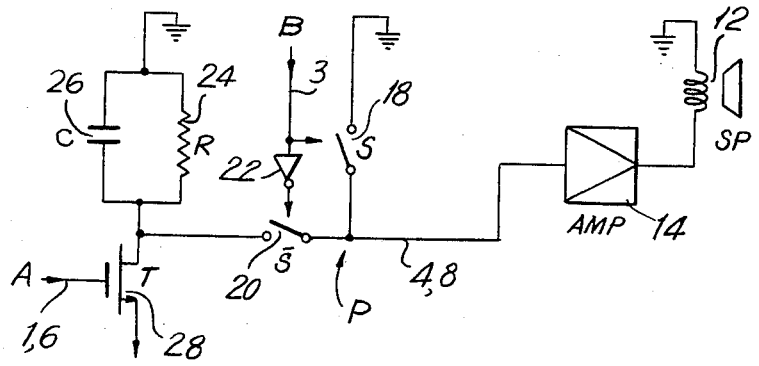
FIG. 3 is a circuit diagram of an electronic music note generator in accordance with the invention.
Figure 4:
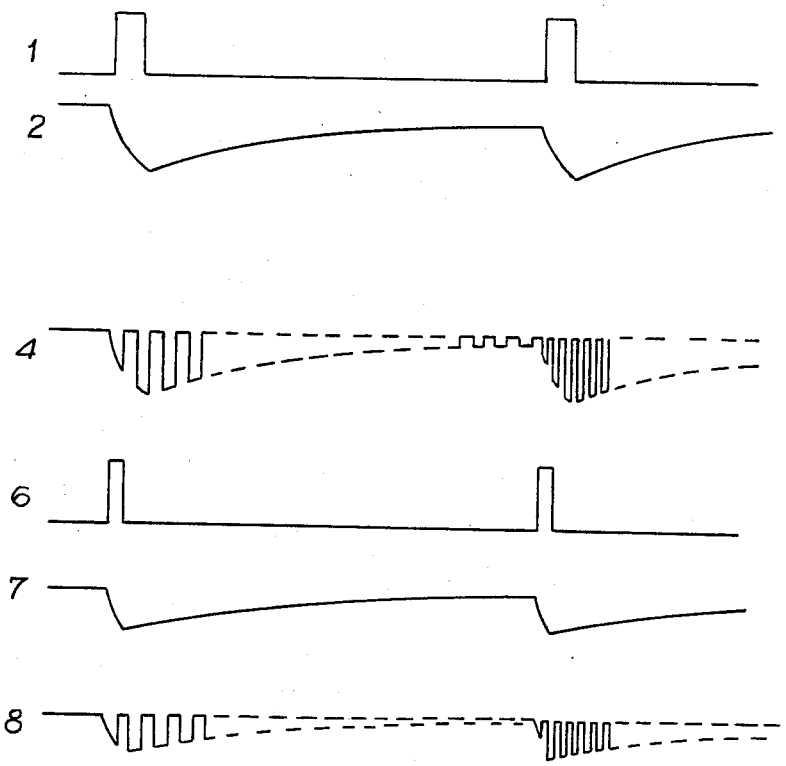
FIG. 4 illustrates timing waveforms associated with the circuit of FIG. 3.

FIGS. 3 and 4 illustrate an embodiment of an electronic music note generator volume control circuit in accordance with the invention where the charge on the capacitor is varied by varying the pulse width of a rhythm signal in order to control the sound volume. Signal waveforms associated with the circuit of FIG. 3 are shown in the FIG. 4 illustrating conditions where the sound volume is high and low. Similar reference numerals are used in the Figures to indicate similar components.

In FIG. 3, the charge on the capacitor 26 is varied by varying the pulse width of the rhythm signal 1 in order to control sound volume. FIG. 4 illustrates signal waveforms at the locations indicated in FIG. 3 and illustrates a high volume signal output 4 and a low volume signal output 8. The rhythm signals 1, 6, are input at the terminal A. The signal 1 is input for a high volume sound and the signal 6 is input for a lower volume sound. The narrower pulse width in the signal 6 results in the lower amplitude signal 8 as compared to the signal 4. As in FIG. 1, a signal 3 (FIG. 2) is applied at the terminal B so as to activate the switches 18, 20 alternately as previously described.

Figure 7:
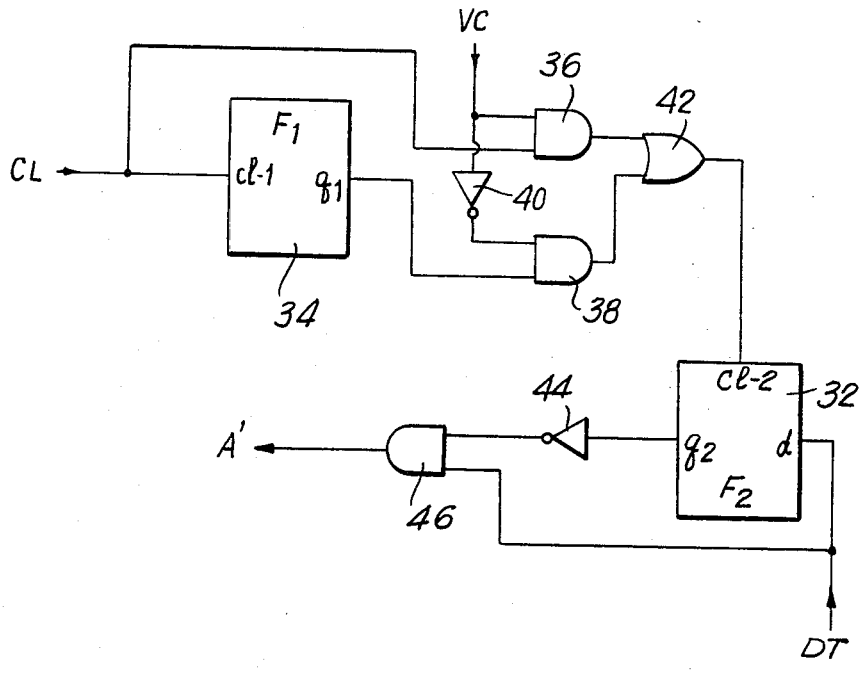
FIG. 7 is a circuit for providing rhythm signals associated with the circuit of FIG. 4.

When the rhythm signal 1, 6 makes the transistor 28 conductive, the capacitor 26 charges through the transistor 28. However, due to the inherent resistance of the transistor 28, the capacitor 26 is less charged during the time when the signal 6 is high than during the time when the signal 1 is high as shown in FIGS. 2, 7. Accordingly, the modulated signal at the circuit point P has a lesser amplitude envelope when the pulse width of the rhythm signal is less. The signals at the point P are fed directly to the amplifier 14 and speaker 12 without the need for any variable resistor since volume control is provided by the level of initial charge on the capacitor 26 while the rhythm signal is high.

Figure 5:
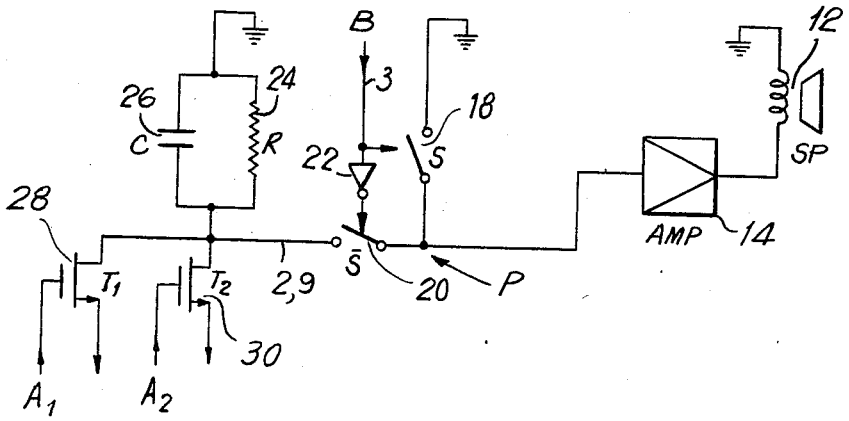
FIG. 5 is a circuit diagram of an alternative embodiment of an electronic music note generator in accordance with the invention.
Figure 6:
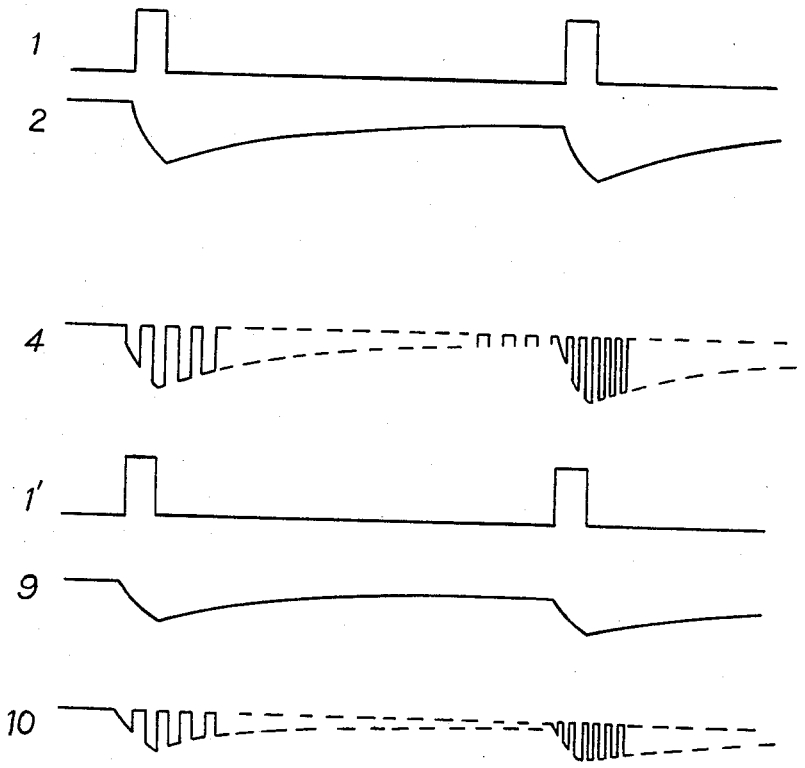
FIG. 6 illustrates timing waveforms associated with the circuit of FIG. 5.

An alternative embodiment of an electronic music note generator in accordance with the invention is illustrated in FIGS. 5 and 6. In the circuit, the charge on the capacitor 26 is controlled by varying the value of the equivalent resistor which represents the transistor through which the capacitor is charged in synchronizism with the rhythm signal. The circuit of FIG. 5 differs from the circuit of FIG. 3 in that two transistors 28, 30 are connected to the RC network in parallel. Thus, the capacitor 26 can be charged through either transistor 28, 30 or through both simultaneously. It should be understood that as before, a frequency signal 3 (FIG. 2) is applied at terminal B to control the pitch or frequency of the notes.

When the amplitude of sound is to be high, a rhythm signal 1 (FIG. 6) is applied to both gates A1, A2 of the transistors 28, 30 simultaneously to produce a decay waveform 2. In other words, when the transistors 28, 30 conduct simultaneously the capacitor 26 charges rapidly through the inherent resistances of the two transistors 28, 30 in parallel. When the signal 1 is low, the capacitor 26 discharges slowly through the resistance 24 as described above. Thus, the signal 2 extends for the entire period of time between the rhythm pulses, although this characteristic is adjustable by varying the RC values. When the signal 2 is modulated by the frequency signal 3 due to the action of the switches 18, 20, the modulated signal 4 is produced at the input P of the amplifier 14.

When a lesser sound amplitude is desired at the speaker output, the pulse width of the rhythm signal 1' is the same as that of the rhythm signal 1 which was used for a high amplitude sound. However, the rhythm signal 1' is applied only to the gate A1 of the transistor 28. In this case, because the value of the equivalent resistor of the transistor 28 is higher than that of the transistors 28, 30 in parallel, a lower level decay waveform 9 is generated and modulated with the pitch frequency 3 to produce the sound signal 10 which is inputted to the amplifier 14 and speaker 12. This reduced amplitude occurs because the capacitor 26 charges to a lower voltage while the signal 1 is high when charging through only one transistor.

These circuits (FIGS. 3, 5) for controlling the pulse width of the rhythm signal, or switching between one or two transistors are easily produced by using conventional techniques and performance is achieved without mechanical operation of variable resistors and switches.

Figure 8:
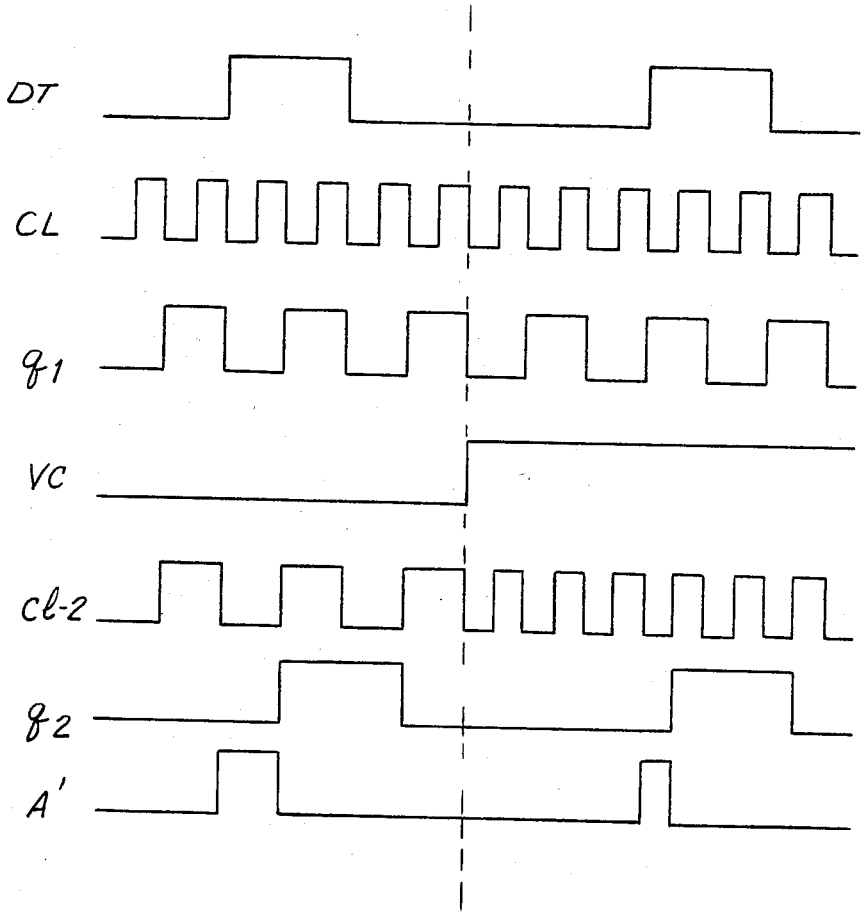
FIG. 8 illustrates timing waveforms associated with the circuit of FIG. 7.

FIG. 7 is a circuit for generating the rhythm signals with different pulse widths like the signals 1 and 6 of FIG. 4. FIG. 8 illustrates the timing charts associated with operation of the circuit of FIG. 8. It should be noted that when only two different pulse widths are generated, the sound volume is only controllable in two steps represented by the different pulse widths.

With reference to FIG. 7, a rising pulse of the signal DT is input to the terminal d of the divider 32 every time a musical note is to be provided during operation of the note generator. At the same time, a rectangular wave clock signal CL is input to the terminal CL-1 of a divider 34 which period is the pulse width of the rising pulse. A signal VC is at low level when the desired sound volume is high and at high level when the desired sound level is low. The signal VC is applied to the input of a AND gate 36 directly and to an input of an AND gate 38 through an inverter 40. The clock signal CL is also directly input to the other input of the AND gate 36, and the output q1 of the divider 34 is input to the other terminal of the AND gate 38.

The divider 34 divides the frequency of the rectangular wave CL by half and delivers the signal q1 to the AND gate 38. When the signal VC is low, the signal from the gate 38 passes through an OR gate 42 to clock the divider 32. When the signal VC is high, the clock signal CL passes through the AND gate 36 and OR gate 42 to clock the divider 32. In other words, the signal CL-2 which clocks the divider 32 has one or the other of two frequencies depending on the state of the signal VC. The leading edge of the clock signal CL-2 clocks the signal DT through the divider 32 to the output q2. The output q2 is inverted in the inverter 44 and input to an AND gate 46. The signal DT is inputted directly to the other terminal of the AND gate 46 and the output of the AND gate 46 is the signal A'. As seen in FIG. 8, the output signal A' has a larger pulse width when the signal VC is low as compared to the pulse width when the signal VC is high. It should be noted that the signal A' is in synchronization with the original pulses of the signal DT. The signal A' is input to the gate A of the transistor 28 in FIG. 3 as the rhythm signal 1.

Figure 9:
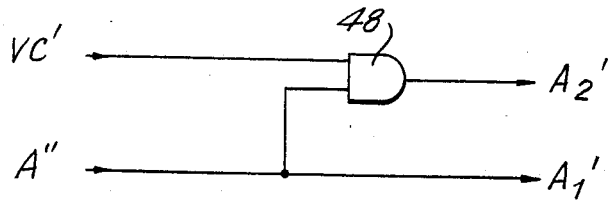
FIG. 9 is a circuit diagram for providing rhythm signals for the circuit of FIG. 5.

FIG. 9 is a circuit for driving the gates of the transistors 28, 30 in FIG. 5 with rhythm signals simultaneously or driving only the gate of the transistor 28 with rhythm signals. In the circuit an AND gate 48 receives an input VC' similar to the signal VC of FIG. 8 and the other terminal of the gate 48 receives an input A'' similar to the inputs 1, 1' of FIG. 6, that is, rhythm signals of constant pulse width. When the rhythm signal is applied to the terminal A'', this rhythm signal is delivered to both terminals A'1 and A'2 when the signal VC' is at a high level. The rhythm signal is delivered only to the terminal A'1 when the signal VC' is at low level. The outputs A2' and A1' are applied to the transistors 28, 30 of FIG. 5.

Accordingly, the electronic music note generator in accordance with the invention provides perfect sound volume control without mechanical operation of parts such as variable resistors or switches, which are relatively expensive.

An electronic music note generator in accordance with this invention is very effective in freely controlling the amplitude of each note performed in a melody by storing the desired amplitude of each note in a memory in various types of devices which include electronic note generation. One example, is an electronic musical generator which performs its melody in accordance with notes stored in a memory and controls the sound volume relative to ambient surrounding noises. A noise meter provides a signal indicative of ambient noise level, for example, raising the level of output from the note generator when the ambient level is high and vice versa. Also, in another application of an electronic note generator in accordance with the invention, the sound volume during the night can be automatically reduced by a control signal from an electronic watch.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In an electronic music note generator outputting audible notes of different pitch or frequency by driving an electro-acoustic output device, the improvement comprising:

a capacitor in a circuit which is adapted to provide for at least partial charging and discharging of the capacitor once for each audible note produced;

first circuit means for periodically applying the instantaneous voltage stored in the capacitor to the input of the electro-acoustic output device as a driving signal, the driving signal being periodically applied at a frequency corresponding to the pitch of the desired musical note; and second circuit means for selectively controlling the maximum charge on the capacitor for each note so that the sound level at the output device varies in proportion to the maximum charge selected for each note, the second circuit means comprising a resistor connected in parallel with the capacitor for discharging the capacitor and a resistive element in series with the capacitor through which the capacitor is charged, the resistive element being adapted to be selectively in a condition to conduct charging current to the capacitor or in a non-conductive condition to allow discharge of the capacitor through the parallel resistor, and the second circuit means selectively controlling the maximum charge on the capacitor by one of allowing different periods of time for charging the capacitor and changing the magnitude of the series resistive element, the series resistive element comprising at least two transistors connected in parallel, the magnitude of the series resistive element and the maximum charge on the capacitor being dependent upon the number of transistors conducting for a fixed time period.

2. In an electronic music note generator outputting audible notes of different pitch or frequency by driving an amplifier which feeds an electro-acoustic output device, the improvement comprising:

a capacitor in a circuit which is adapted to provide for at least partial charging and discharging of the capacitor once for each audible note produced;

first circuit means comprising a switch for periodically applying the instantaneous voltage stored in the capacitor to the input of the amplifier as a driving signal, the driving signal being periodically applied at a frequency corresponding to the pitch of the desired musical note; and second circuit means for selectively controlling the maximum charge on the capacitor for each note, whereby the sound level at the output device is in proportion to the maximum charge selected for each note, the second circuit means comprising a resistor connected in parallel with the capacitor for discharging the capacitor and a resistive element in series with the capacitor through which the capacitor is charged, the resistive element being adapted to be selectively in a condition to conduct charging current to the capacitor or in a condition of non-conduction to allow discharge of the capacitor through the parallel resistor, the RC time for charging the capacitor being less than the RC time for discharge of the capacitor so that a decaying sound occurs between notes, and the second circuit means selectively controlling the maximum charge on the capacitor, when charging, by one of allowing different periods of time for charging the capacitor and changing the magnitude of the resistive element, the series resistive element comprising at least two transistors connected in parallel, each transistor being selectively subject to being made conductive to charge the capacitor and both transistors being made non-conductive simultaneously to permit discharge of the capacitor, the magnitude of the resistive element being varied and the charge on the capacitor being dependent upon the number of the transistors conducting simultaneously during a fixed time period.

* * * * *